US009863187B2

(12) United States Patent
Parker

(10) Patent No.: US 9,863,187 B2
(45) **Date of Patent: *Jan. 9, 2018**

(54) TUBULAR ACCESS LADDER AND METHOD

(71) Applicant: Thomas W. Parker, Jamestown, PA (US)

(72) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 267 days.

This patent is subject to a terminal disclaimer.

(21) Appl. No.: 13/735,554

(22) Filed: Jan. 7, 2013

(65) Prior Publication Data

US 2014/0190766 A1 Jul. 10, 2014

Related U.S. Application Data

(62) Division of application No. 13/134,656, filed on Jun. 14, 2011, now Pat. No. 8,348,015, which is a division of application No. 11/494,217, filed on Jul. 27, 2006, now Pat. No. 7,967,110.

(51) Int. Cl.

| | |
|---|---|
| ***E06C 1/12*** | (2006.01) |
| ***E06C 9/08*** | (2006.01) |
| ***E04F 11/06*** | (2006.01) |

(52) U.S. Cl.

CPC ..... *E06C 1/125* (2013.01); *E04F 11/06* (2013.01); *E04F 11/068* (2013.01); *E06C 1/12* (2013.01); *E06C 9/08* (2013.01)

(58) Field of Classification Search

CPC ..... E04F 11/06; E04F 11/068; E06C 1/125; E06C 1/12

USPC ..... 182/95, 211, 195

See application file for complete search history.

(56) References Cited

U.S. PATENT DOCUMENTS

| | | | | | |
|---|---|---|---|---|---|
| 2,446,434 | A | * | 8/1948 | Rechain | 182/78 |
| 2,529,112 | A | * | 11/1950 | Steele | 182/21 |
| 2,827,216 | A | * | 3/1958 | Napolitano | 182/104 |
| 2,907,401 | A | * | 10/1959 | Wagner | 182/78 |
| 3,033,309 | A | * | 5/1962 | Fugere | B60R 3/02 182/189 |
| 3,862,670 | A | * | 1/1975 | Hovey | B63B 27/146 182/195 |
| 3,997,026 | A | * | 12/1976 | Riehlmann | 182/96 |
| 4,119,177 | A | * | 10/1978 | Andersson | 182/195 |

(Continued)

FOREIGN PATENT DOCUMENTS

| | | | | | |
|---|---|---|---|---|---|
| CN | WO 2008064532 | A1 | * | 6/2008 | E06C 1/125 |
| DE | 9407043 | U1 | * | 10/1994 | E06C 1/125 |

(Continued)

*Primary Examiner* — Katherine Mitchell
*Assistant Examiner* — Marcus Menezes
(74) *Attorney, Agent, or Firm* — Ansel M. Schwartz

(57) ABSTRACT

An access ladder includes a plurality of sections connected together to telescope between an extended position and a retracted position that has an increasing reactive force to counterbalance the weight of the sections as they extend. A method for accessing a room with a ladder connected to a ceiling including the steps of moving the ladder to a fully extended position subject to an increasingly active force to counterbalance the weight of the ladder as it extends. There is the step of retracting the ladder into a retracted position in the ceiling.

13 Claims, 9 Drawing Sheets

(56) References Cited

U.S. PATENT DOCUMENTS

| | | | | |
|---|---|---|---|---|
| 5,495,915 | A * | 3/1996 | Weston | E06C 1/125 182/195 |
| 5,743,355 | A * | 4/1998 | McDonnell | E06C 1/125 182/195 |
| 6,708,800 | B2 * | 3/2004 | Kieffer | E06C 1/125 182/195 |
| 6,904,863 | B2 * | 6/2005 | Mardikian et al. | 114/362 |
| 7,182,175 | B1 * | 2/2007 | Schmitt et al. | 182/88 |
| 7,967,110 | B2 * | 6/2011 | Parker | E06C 1/125 182/195 |
| 8,348,015 | B2 * | 1/2013 | Parker | 182/77 |
| 8,708,102 | B2 * | 4/2014 | Mickens | B60R 3/00 182/127 |
| 8,939,256 | B2 * | 1/2015 | Nielsen | E06C 1/125 182/195 |
| 9,260,917 | B2 * | 2/2016 | Weston | E06C 1/125 |
| 2004/0195043 | A1 * | 10/2004 | Johansson | E06C 1/125 182/195 |
| 2007/0234654 | A1 * | 10/2007 | Eriksson | E04F 11/062 52/184 |
| 2008/0023269 | A1 * | 1/2008 | Parker | 182/195 |
| 2009/0050407 | A1 * | 2/2009 | Eriksson | 182/195 |

FOREIGN PATENT DOCUMENTS

| | | | | |
|---|---|---|---|---|
| JP | 3542645 B2 * | 7/2004 | | E06C 1/125 |
| SE | 2413148 A * | 10/2005 | | E06C 1/125 |

* cited by examiner

TUBULAR ACCESS LADDER AND METHOD

This is a divisional of U.S. patent application Ser. No. 13/134,656 filed Jun. 14, 2011, which is a divisional of U.S. patent application Ser. No. 11/494,217 filed Jul. 27, 2006, now U.S. Pat. No. 7,967,110 issued Jun. 28, 2011, all of which are incorporated by reference herein.

FIELD OF THE INVENTION

The present invention relates to an access ladder. More specifically, the present invention relates to an access ladder having a plurality of sections connected together to telescope between an extended position and a retracted position that has an increasing reactive force to counterbalance the weight of the sections as they extend.

BACKGROUND OF THE INVENTION

Many houses today, whether new construction or older, have access holes in the ceiling in order to provide entry into the areas under the roof or into crawlspaces above the ceiling. These rectangular access holes are commonly located in hallways or in closets and are typically small, sometimes as small as 22 inches by 28 inches. It is standard practice for a person desiring to get into the area above the access hole to use a ladder. If this ladder is long enough to reach up through the access hole then it is likely too long to store in the house unless lying horizontally. If stored elsewhere, such as in a garage, the ladder is difficult to maneuver through the house. In any case, climbing up through the access hole is not convenient. Because of this inconvenience, potential storage space above the access hole remains unused.

The primary purpose of this invention is to provide an extendable easy to use ladder which is conveniently mounted in the access hole.

BRIEF SUMMARY OF THE INVENTION

The present invention pertains to an access ladder. The ladder comprises a plurality of sections connected together to telescope between an extended position and a retracted position that has an increasing reactive force to counterbalance the weight of the sections as they extend.

The present invention pertains to a method for accessing a room with a ladder connected to a ceiling. The method comprises the steps of moving the ladder to a fully extended position subject to an increasingly active force to counterbalance the weight of the ladder as it extends. There is the step of retracting the ladder into a retracted position in the ceiling.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
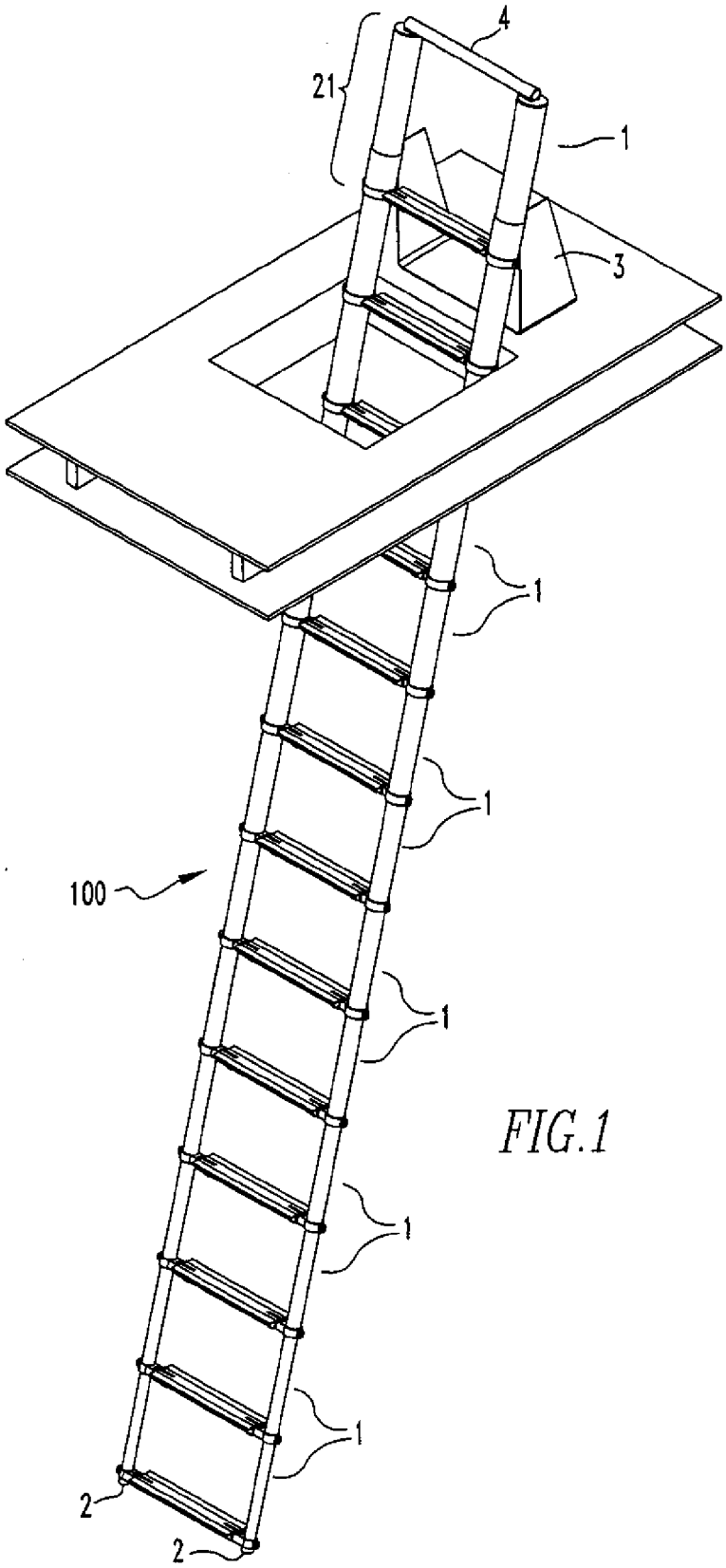
FIG. 1 is a perspective view of the ladder of the present invention in an extended position.
Figure 2:
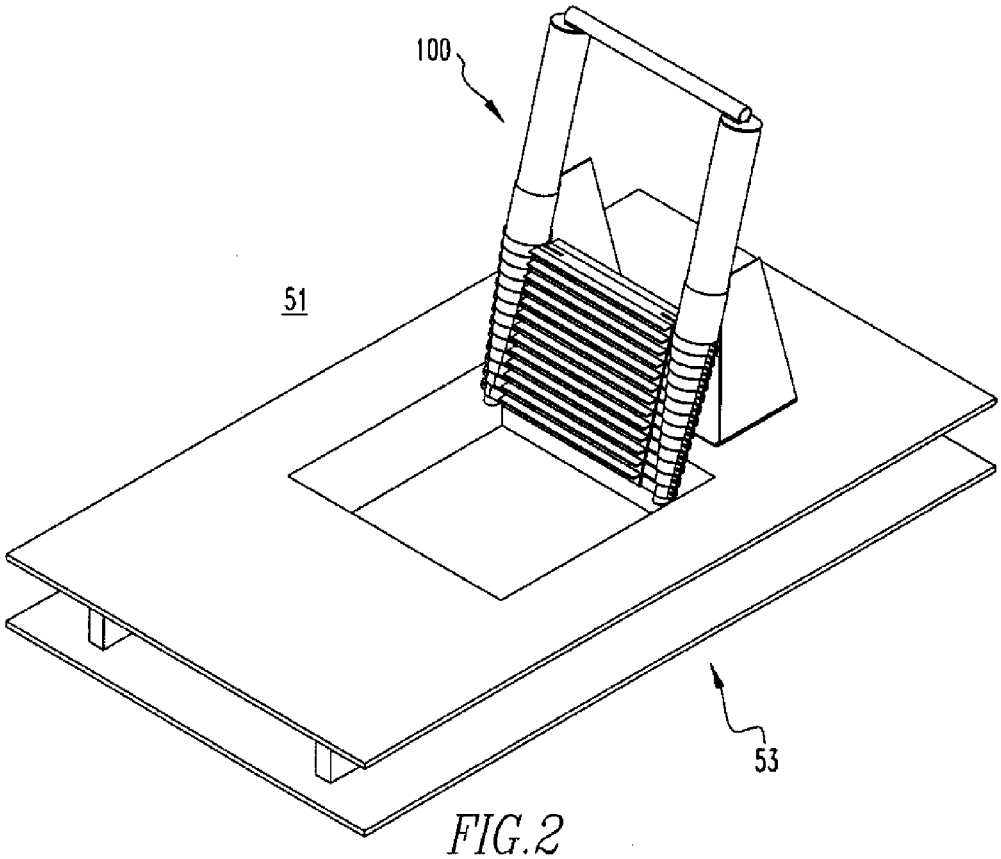
FIG. 2 is a perspective of the ladder in a retracted position.

Referring now to the drawings wherein like reference numerals refer to similar or identical parts throughout the several views, and more specifically to FIGS. 1 and 2 thereof, there is shown an access ladder 100. The ladder 100 comprises a plurality of sections connected together to telescope between an extended position and a retracted position that has an increasing reactive force to counterbalance the weight of the sections as they extend.

Preferably, each section has a step 5 and a tube 8 on each side of the step 5, as shown in FIGS. 3-7. The tubes 8 of each section are slightly smaller in diameter than the tubes 8 of the section above it so the sections can telescope to the extended and retracted positions. The sections preferably include a lowest section 25*b*, an uppermost section 21 and a middle section 25. Preferably, each middle section 25 has a plunger assembly 7 at each side of the step 5 which slides between an extended position and a retracted position, when in the retracted position the plunger assembly 7 does not protrude into the tube 8 so the section can move relative to the section above it, when in the extended position the plunger assembly 7 protrudes into the tube 8 so the section is locked in place relative to the section below it.

Figure 7:
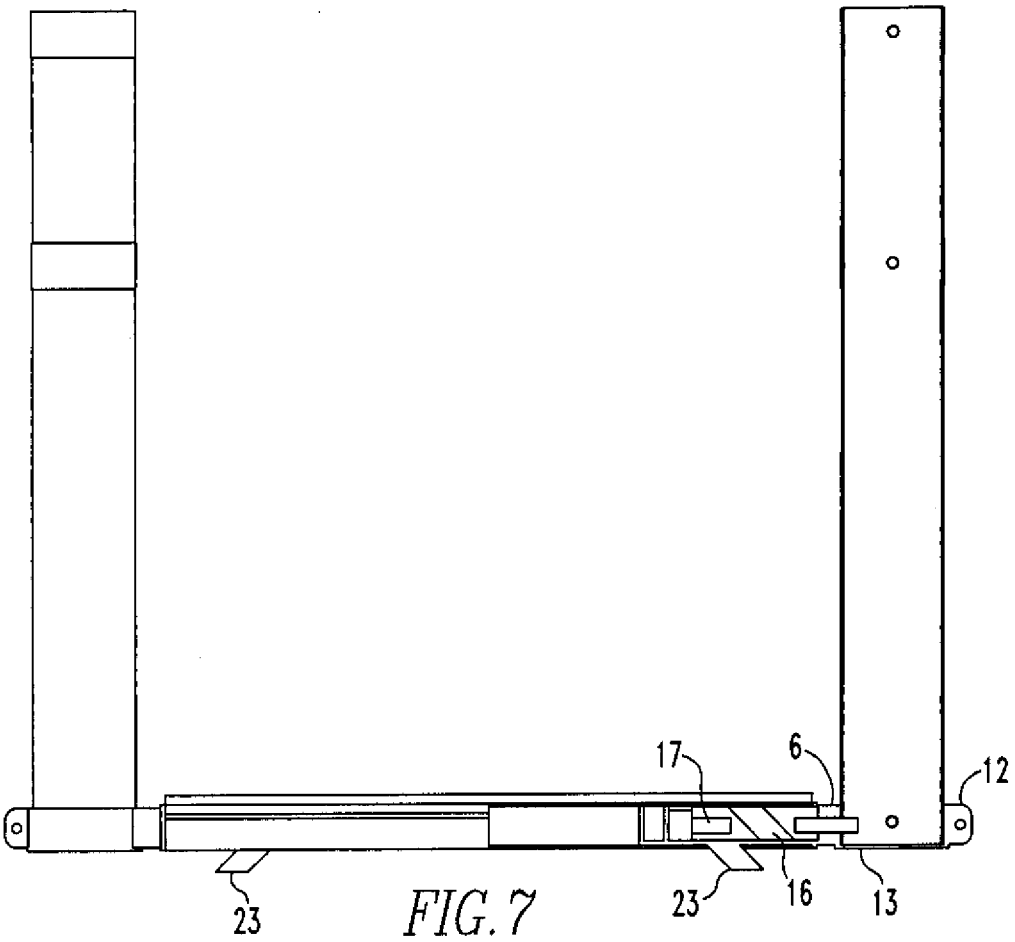
FIG. 7 is a front view of the middle section partially cut away.
Figure 10:
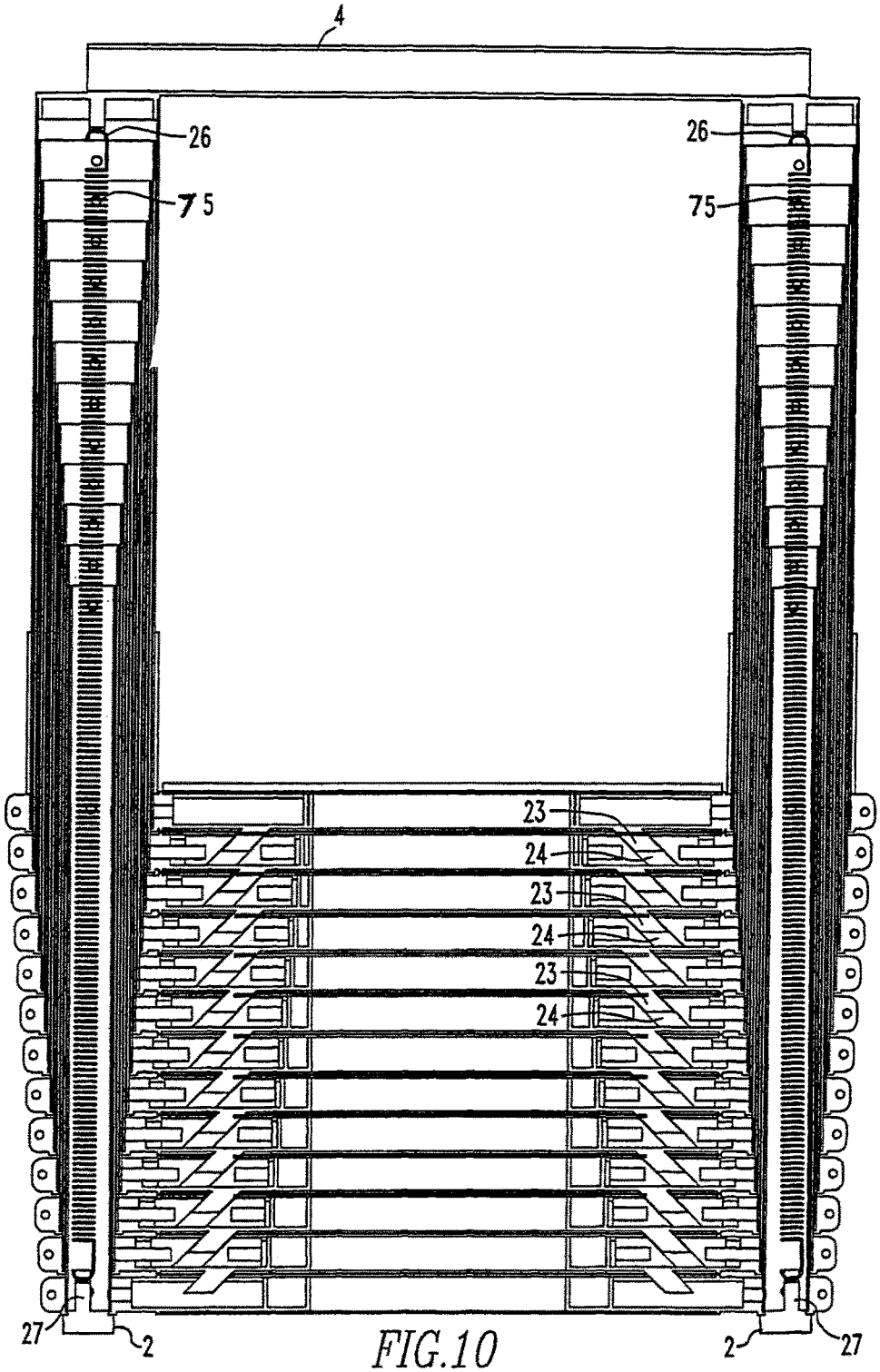
FIG. 10 is a front view of the ladder in a retracted position with the sections cut away.

The tubes 8 of each side of the sections preferably align to form a channel, and including an extension spring 75 that extends along each channel from the uppermost section 21 to the lowest section 25*b*, as shown in FIG. 10. Preferably, each section includes a tube bottom 6 fitted into each side of the step 5, that has a cam portion 23 that protrudes through a slot in the step 5 and has a ring shaped portion that holds the tube 8. The plunger assembly 7 preferably includes a plunger body 14 having a cam slot 16 which receives the cam portion 23 and is caused to be moved to their retracted position as the cam portion 23 moves into the cam shot 16, and a spring recess 17 which recesses a plunger spring (not shown) which tends to force the plunger assembly 7 away from the center of the step 5, as shown in FIG. 7. The plunger assembly 7 including a plunger 15 that engages with the tube 8 in the extended position.

Figure 8:
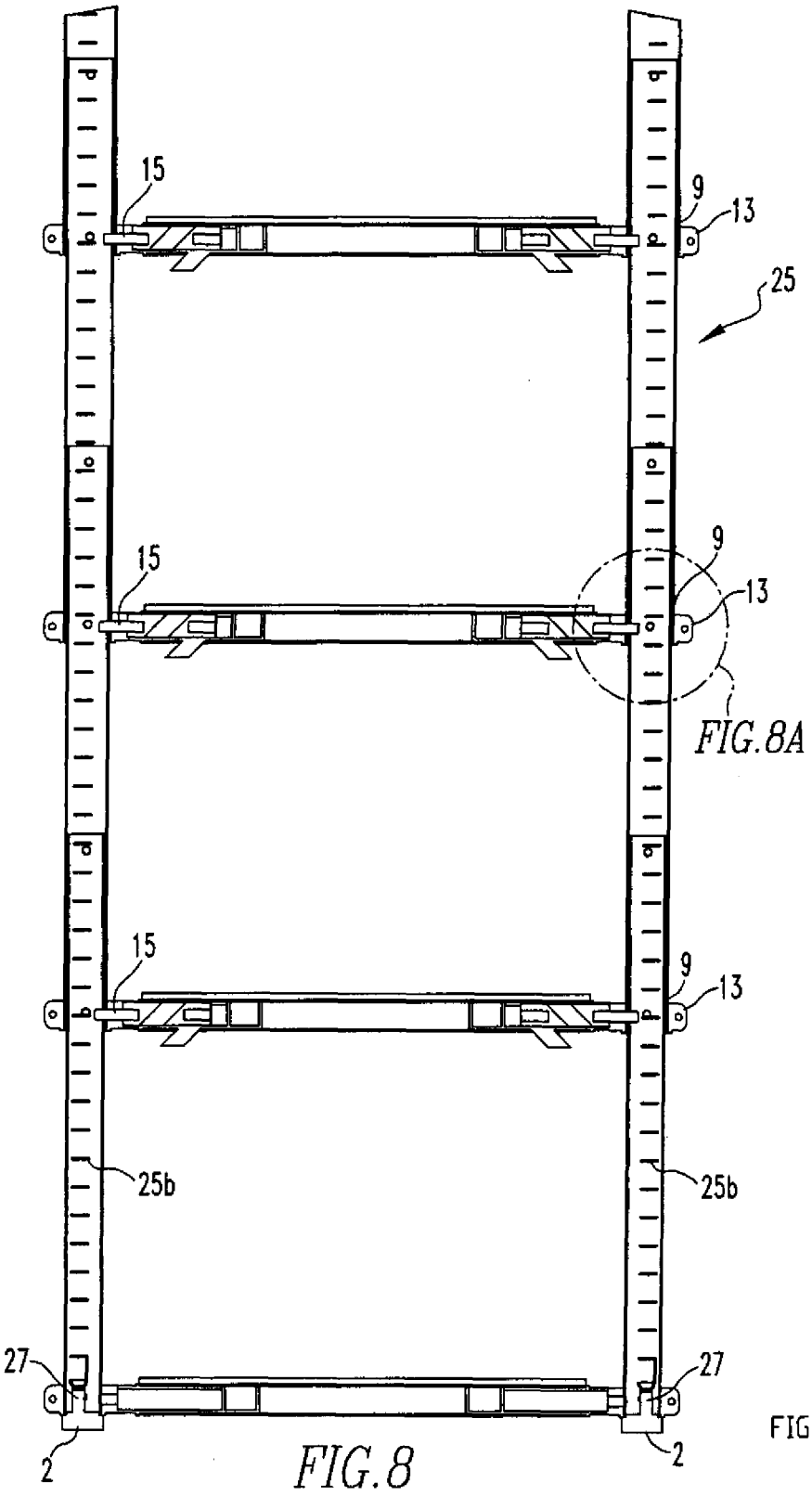
FIG. 8 is a front view of a bottom portion of the ladder in an extended position with sections cut away.
Figure 9:
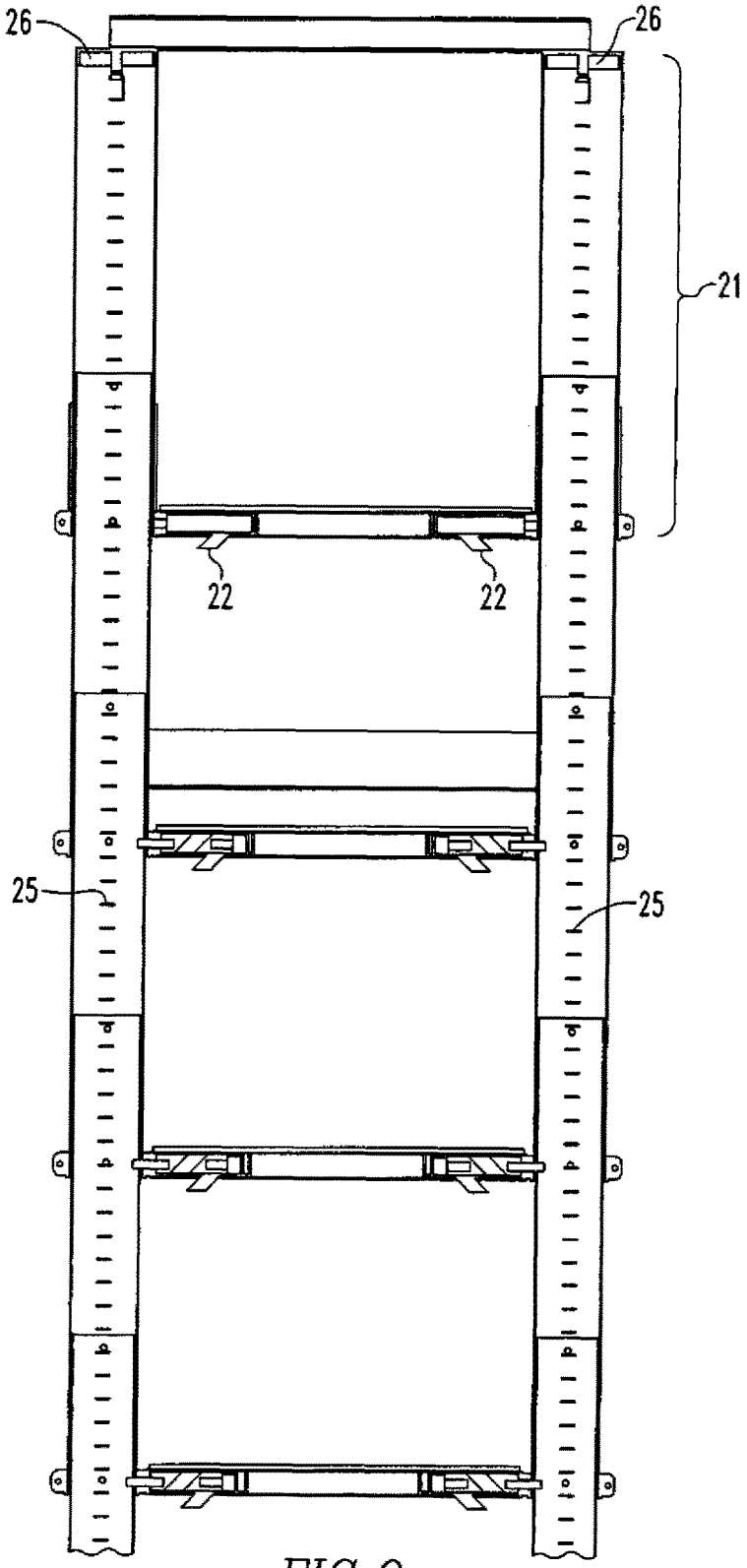
FIG. 9 is a front view of an upper portion of the ladder with the sections cut away.

Preferably, each section has a least an upper guide 9 disposed about each tube 8 that serves as a sliding bearing between sections. The uppermost section 21 preferably does not have any plunger assembly 7 so the sections below the uppermost section 21 may be forced up relative to the uppermost section 21 into the retracted position, as shown in FIG. 9. Preferably, the lowest section 25*b* does not have any plunger assembly 7 so it can be pulled down relative to the section above it until the plunger assemblies 7 in the section above it move into holes 32 in the tubes 8 in the lowest section 25*b*, as shown in FIG. 8.

The present invention pertains to a method for accessing a room 51 with a ladder 100 connected to a ceiling 53. The method comprises the steps of moving the ladder 100 to a fully extended position subject to an increasingly active force to counterbalance the weight of the ladder 100 as it extends. There is the step of retracting the ladder 100 into a retracted position in the ceiling.

Preferably, the moving step includes the step of pulling down a lowest section 25*b* of the ladder 100 until plunger assemblies 7 in a section above it find corresponding holes 32 in tubes 8 of the lowest section 25*b* in the plunger assemblies 7 extend into the corresponding holes 32. The retracting step includes the step of forcing sections of the ladder 100 below an uppermost section 21 of the ladder 100 up relative to the uppermost section 21 so cam portions 23 on the tube bottoms 6 of the uppermost section 21 will cam the plunger assemblies 7 of the section below it into their fully retracted positions.

FIG. 1 shows the ladder 100 mounted in an access opening and in the fully extended position with the feet of the ladder 100 resting on the floor. FIG. 2 shows the ladder 100 in the fully retracted position.

The ladder 100 consists of several sections 1. Feet 2 are attached to the bottom section and a mounting bracket 3 is attached to the uppermost or mounting section 21. This mounting bracket fixes the mounting section 21 rigidly with respect to the attic floor. Alternatively, the mounting bracket could be shaped so as to attach the mounting section rigidly to one face of the access opening. A cross piece 4 is attached to the mounting section. This cross piece serves both to stiffen the ladder 100 and provide a hand hold for the user.

Figure 3:
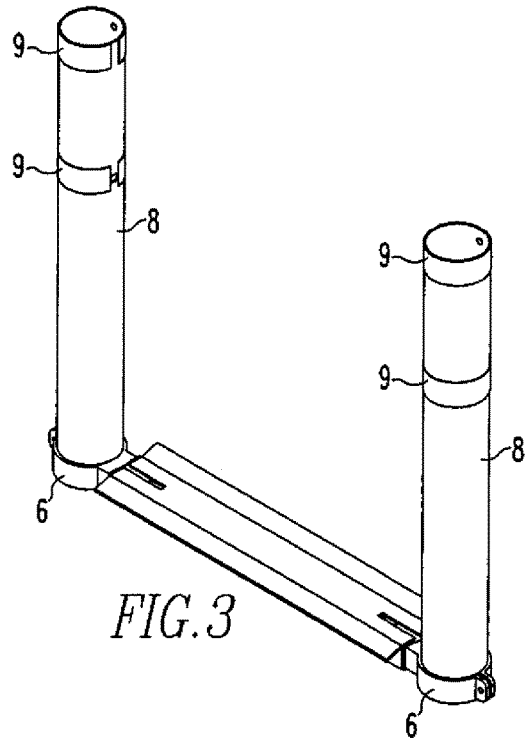
FIG. 3 is a perspective view of a middle section of the ladder.
Figure 4:
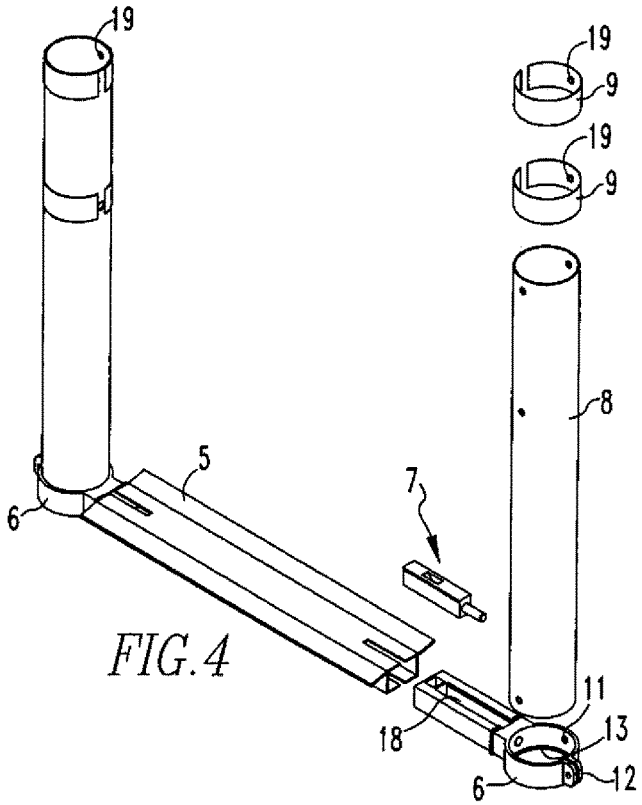
FIG. 4 is a perspective exploded view of the middle section.
Figure 5:
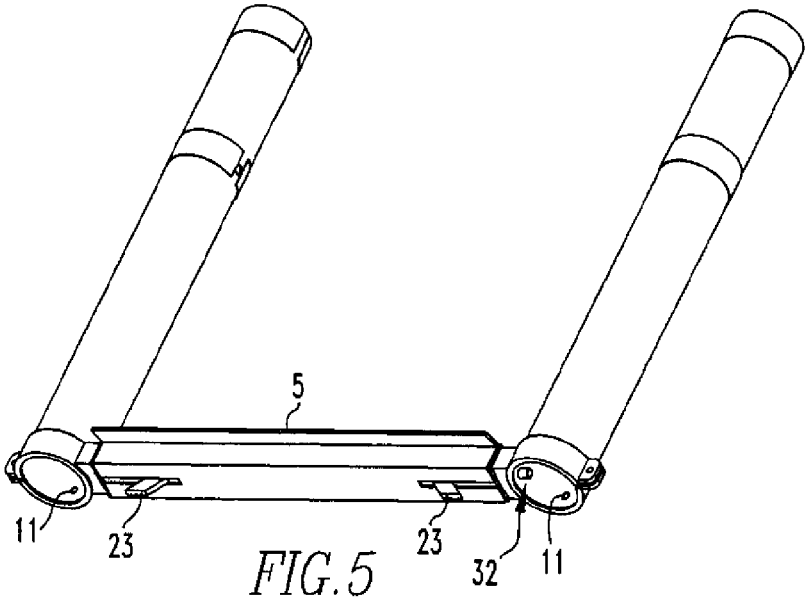
FIG. 5 is a perspective view of the middle section.
Figure 6:
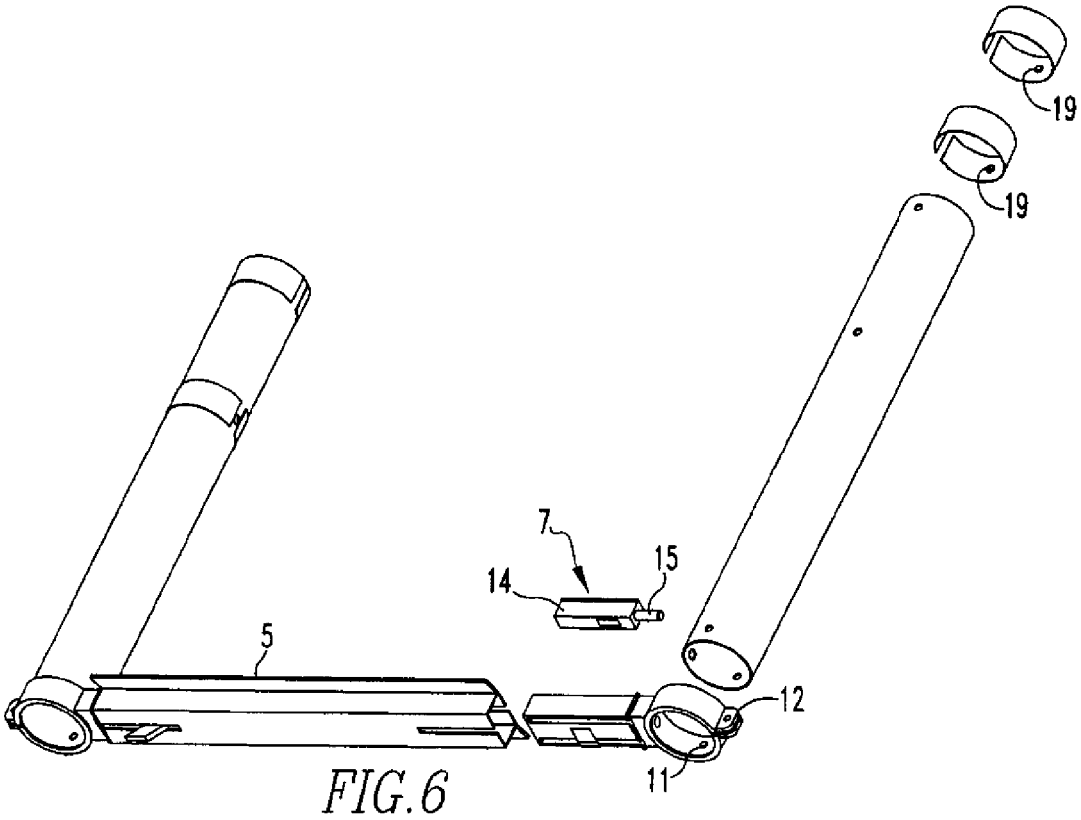
FIG. 6 is a perspective exploded view of the middle section.

A typical section is shown in FIG. 3 and FIG. 5. The section is shown partially exploded in FIG. 4 and FIG. 6. FIG. 7 shows a section partially cut away.

Components of a section are the step 5, two tube bottoms 6, two plunger assemblies 7, two tubes 8, and four upper guides 9. The tubes 8 of each section of the ladder 100 are slightly smaller in diameter than the tubes 8 of the section above it so that the sections can "telescope" to the extended and retracted positions.

The tube bottom 6 is a molded plastic part which is a press fit into the aluminum step 5. A cam 23 of the tube bottom 6 protrudes through a slot in the underside of the step 5. The aluminum tube is a close fit into the tube bottom 6. The ring shaped portion of the tube bottom 6 is split to allow studs 11 on the inside of the tube bottom 6 ring shaped portion to fit into mating holes in the tube 8 during assembly. These studs lock the tube bottom 6 to the tube 8 rotationally and axially. A rivet, not shown, through the tabs 12 at the split of the tube bottom 6 make the tube bottom 6 to tube assembly permanent. A lip 13 on the tube bottom 6 seen in FIG. 4 and FIG. 7 protrudes radially inward past the inside diameter of the tube 8.

The plunger assembly 7 consists of a molded plastic body 14 and the steel plunger 15 which is pressed or over-molded in place to form a permanent assembly. The plunger body 14 has a cam slot 16 and a plunger spring recess 17 molded in, visible in FIG. 7.

As seen in FIG. 4 and FIG. 7, the plunger assembly 7 fits closely in a slot 18 in the tube bottom 6. A plunger spring, not shown, fits into the recess in the plunger assembly 7 and tends to force the plunger assembly 7 away from the center of the step 5. The plunger assembly 7 can slide between a fully extended and fully retracted position. In FIGS. 3, 5 and 7, it is shown in the fully extended position. In this position, the steel plunger 15 protrudes into the tube 8. When fully retracted, the steel plunger 15 does not protrude into the tube 8.

The upper guides 9 are thin molded plastic. They are "C" shaped with two studs 19 molded on their inner surfaces. These studs fit into mating holes in the tube 8 during assembly, thus locking the upper guides rotationally and axially relative to the tube 8. The upper guides 9 are kept from disengaging from the tube 8 of the section to which they belong by being a close sliding fit in the tube 8 of the next section above in the ladder 100. The upper guides 9 serve as low friction sliding bearings between sections of the ladder 100.

Figure 8A:
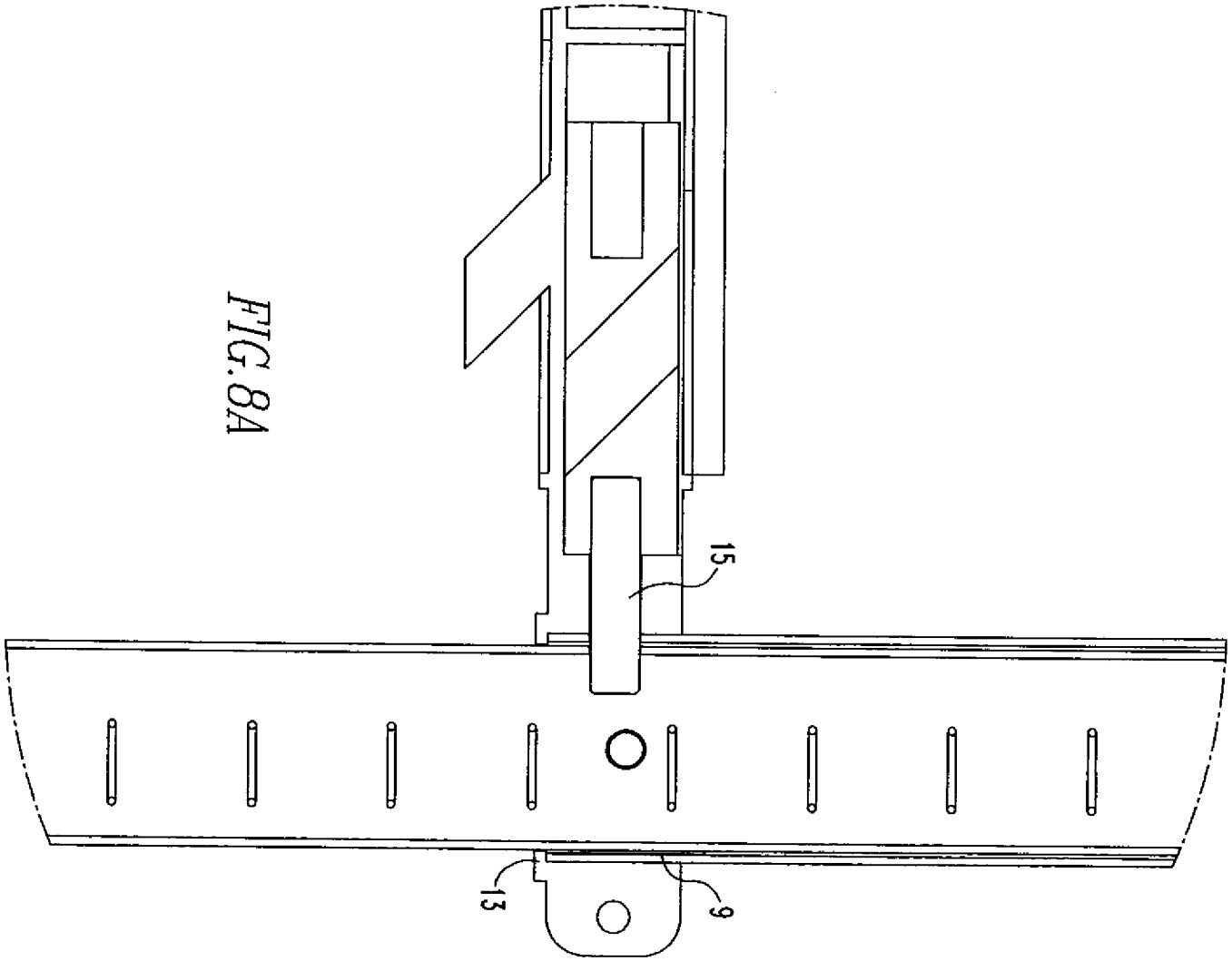
FIG. 8*a* is a detailed view of a portion of the ladder of FIG. 8.

FIG. 8 shows a few of the extended ladder 100 sections cut away. In this extended position, the lower of the upper guides 9 on a particular section bottom out against the lip of the tube bottom 6 of the next higher section, thus preventing the sections from pulling apart. See FIG. 8A for more detail. In addition the steel plungers 15 of a particular section engage holes in the tubes 8 of the section below it, thus positively preventing the ladder 100 from telescoping shut.

FIG. 9 shows the sections at the upper end of the ladder 100. The uppermost section 21, the mount section 21, does not have any plunger assemblies 7. Thus, the sections below the mount section may be forced up relative to the mount section. When this is done, in order to retract the ladder 100, the cam portions 23 on the tube bottoms 6 of the mount section will cam the plunger assemblies 7 of section one below it into their fully retracted positions just as section one reaches its fully retracted position. Once that happens, section two continues to rise until its plunger assemblies 7 are cammed to the fully retracted positions, thus allowing section three to continue to rise, etc., until all sections are retracted.

FIG. 10 is a cutaway of the completely retracted ladder 100. With the exception of the lowest section 25*b*, each section is locked to the section above it by the cam portions 23 of the tube bottoms 6 of the upper section of any given pair of sections being engaged with the cam slots 16 of the plunger assemblies 7 of the lower section of any given pair of sections. Note that the plunger assemblies 7 in any section are prevented from moving to their fully extended positions (and so releasing the section to which they belong) by the steel plunger 15 not being aligned with the mating holes in the tubes 8 of the section below it.

Since the lowest section 25*b* does not have any plunger assemblies 7, it can be pulled down relative to the section above it until the plunger assemblies 7 in the section above it "find the holes" in the tubes 8 of the lowest section 25*b*, the plunger assemblies 7 extend, that section is released from the section above it and it begins to extend as well. This sequence continues until all sections are fully extended.

Thus, when extending the ladder 100, the lowest section 25*b* descends first until it is fully extended relative to the section above it and the plunger assemblies 7 have extended to lock the lowest section 25*b* to the section above it. Then the section above it can descend until it is locked to the next section above it, etc. When the ladder 100 is fully extended the weight of someone climbing the ladder 100 is transmitted through the series of tubes 8 and plungers 15 to the floor on which the ladder 100 rests.

In FIGS. 8, 9, and 10, two extension springs 75 may be seen. The ends of these extension springs 75 are hooked at their upper ends to projections 26 on the cross piece 4 and at their lower ends to projections 27 on the feet 2. These extension springs 75 are designed to provide an increasing retractive force to counter balance the weight of the sections as they extend. Thus the ladder 100 will not free fall when extending and may be closed with little effort.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An access ladder comprising:

a plurality of sections connected together to telescope between an extended position and a retracted position, the plurality of sections having a plurality of plunger assemblies disposed in the sections which positively prevent the ladder from retracting into the retracted position, and a plurality of extension springs disposed in the sections, the plurality of springs are configured to produce an increasing reactive force to counterbalance a weight of the sections as the sections extend so the ladder does not free fall and is put in an extended position, the plunger assemblies are all configured to automatically release the ladder from the extended position to allow the ladder to be placed in the retracted position when an upward force is continuously applied to the sections.

2. A ladder as described in claim 1 wherein each section has a step and a tube on opposite sides of the step, the tubes of each section are slightly smaller in diameter than the tubes of a section above each section so the sections can telescope to the extended and retracted positions.

3. A ladder as described in claim 2 wherein the sections include a lowest section, an uppermost section and a plurality of middle sections.

4. A ladder as described in claim 3 wherein each middle section has a step and has one of the plunger assemblies at each side of the step which slides between an extended position and a retracted position of the plunger assembly; wherein when each middle section is in the retracted position, each middle section's plunger assembly does not protrude into a respective tube so each middle section can move relative to a middle section above itself; wherein when in the extended position of the plunger assembly, the plunger assembly of each middle section protrudes into the respective tube so each middle section is locked in place relative to a middle section below itself.

5. A ladder as described in claim 4 wherein the tubes of each side of the sections align to form a channel, and wherein each extension spring extends along each channel from the uppermost section to the lowest section.

6. A ladder as described in claim 5 wherein each section includes a tube bottom of each tube fitted into each side of the step of the respective section, each tube bottom has a cam portion that protrudes through a slot in the respective step and has a ring shaped portion that holds the respective tube.

7. A ladder as described in claim 6 wherein each plunger assembly includes a plunger body having a cam slot which receives a cam portion and each plunger assembly is moved to the plunger assembly's retracted position as the respective cam portion moves into the respective cam slot, and a spring recess which recesses a plunger spring which tends to force each plunger assembly away from a center of a step, each plunger assembly including a plunger that engages with the respective tube of the respective step associated with the plunger assembly in the extended position.

8. A ladder as described in claim 7 wherein each section has at least an upper guide disposed about each tube that serves as a sliding bearing between sections.

9. A ladder as described in claim 8 wherein the uppermost section does not have any plunger assembly so the sections below the uppermost section are forced up relative to the uppermost section into the retracted position when the plunger assemblies are released and when the upward force is continuously applied to the sections.

10. A ladder as described in claim 9 wherein the lowest section does not have any plunger assembly so the lowest section can be pulled down relative to the section above the lowest section until the plunger assemblies in the section above the lowest section move into holes in the tubes in the lowest section.

11. A method for accessing a room with a ladder connected to a ceiling having a plurality of steps comprising the steps of:

moving the ladder to a fully extended position as the ladder is moved from a retracted position, the ladder experiencing an increasingly reactive force from a plurality of extension springs disposed in a plurality of sections of the ladder to counterbalance a weight of the ladder as the ladder extends so the ladder does not free fall and is put in the fully extended position, with a plurality of plunger assemblies disposed in the plurality of sections positively preventing the ladder from retracting to the retracted position; and retracting the ladder into the retracted position above the ceiling, the plunger assemblies configured to automatically release the ladder from the extended position to allow the ladder to be placed in the retracted position when an upward force is continuously applied to the sections.

12. A method as described in claim 11 wherein the step of moving the ladder includes a step of pulling down a lowest section of the ladder until plunger assemblies in a section above the lowest section extend into corresponding holes in tubes of the lowest section.

13. A method as described in claim 12 wherein the retracting step includes a step of forcing sections of the ladder below an uppermost section of the ladder up relative to the uppermost section so cam portions on tube bottoms of the uppermost section will cam plunger assemblies of the section below uppermost section into fully retracted positions.

* * * * *